United States Patent [19]

Cornelis

[11] 4,012,557

[45] Mar. 15, 1977

[54] NYLON-6 FILAMENT AND METHOD OF MANUFACTURE THEREOF

[76] Inventor: Jean-Philippe Cornelis, Clementinalaan 40, B-9000 Gent, Belgium

[22] Filed: Aug. 6, 1975

[21] Appl. No.: 602,526

Related U.S. Application Data

[63] Continuation-in-part of Ser. No. 365,597, May 31, 1973, abandoned.

[30] Foreign Application Priority Data

June 2, 1972 France ..... 72.20021

[52] U.S. Cl. ..... 428/397; 264/177 F; 264/210 F; 264/211; 264/341; 428/400

[51] Int. Cl.[2] ..... D02G 3/02

[58] Field of Search ..... 264/177 F, 341, 211, 264/210 F, 290 N; 428/397, 400

[56] References Cited

UNITED STATES PATENTS

| | | | |
|---|---|---|---|
| 2,904,840 | 9/1959 | Hockreufer | 260/2.5 E |
| 3,233,019 | 2/1966 | Adams | 264/290 T |
| 3,671,379 | 6/1972 | Evans et al. | 161/177 |
| 3,729,449 | 4/1973 | Kimuva et al. | 161/177 |
| 3,806,487 | 4/1974 | Silverman | 260/37 N |

*Primary Examiner*—Jay H. Woo
*Attorney, Agent, or Firm*—Silverman & Cass, Ltd.

[57] ABSTRACT

A nylon-6 filament and a method for manufacturing the same to achieve a high degree of permeability to ultraviolet rays in fabric formed from such filament comprising the steps of adding potassium or sodium bromide to the filament to render the same more pervious to ultraviolet rays than before such treatment, spinning the filament by extrusion, treating the spun filament with a solvent which dissolves superficially the filament surface with cooling after each of the steps to prevent the generation of spherulites, the extruded filament being preferably of an oval cross-sectional shape. Further it is optional to color the filament.

8 Claims, No Drawings

NYLON-6 FILAMENT AND METHOD OF MANUFACTURE THEREOF

CROSS-REFERENCE TO RELATED APPLICATION

This application is a continuation-in-part of applicant's copending application Ser. No. 365,597, filed May 31, 1973, now abandoned.

BACKGROUND OF THE INVENTION

The present invention relates to a synthetic polymeric filament and to the preparation thereof.

The synthetic polymer is a polyamide that is known as nylon-6. Nylon-6 is chemically variously described as polymerized 6-amino caproic acid, polycaproamide or polyepsiloncaprolactam. In fiber form nylon-6 is known as Perlon L or Perlon.

As is known, both nylon-6 and nylon-66 (originally produced) are polyamides that are widely used for the production of fabrics for clothing. Nylon-66 is chemically polyhexamethylene adipamide. However, applicant has determined that nylon-66 has a crystallization speed that cannot be influenced by lowering temperature in order to meet the objective of the present invention. Accordingly, nylon-66 is excluded.

Nylon polyamides are commercially available in powder form for molding purposes.

The nylon-6 filament of the present invention differs from the conventional nylon-6 filament in that it allows fabric made therefrom to become pervious to ultraviolet rays from light sources such as sunlight.

Fabrics, thus highly permeable to ultraviolet rays, while suitable for making clothing in general, are particularly desirably suitable for making bathing costumes and beach clothes. Notwithstanding the danger of erythema, there is present day scientific evidence that the rays of sunlight do impart benefits to the human body. Accordingly, these benefits to the human body are denied by conventional outdoor vacation wear.

Attempts have been made in the past to achieve greater permeability of ultraviolet rays when making sportswear, as for bathing, for example, as follows.

German Pat. No. 535,817 (1931) employs a fiber mixture of glass fiber, cellulose, cellulose derivatives, products, synthetic glyptal, polyvinyl or polyacrylic acid and urea products.

German Pat. No. 826,581 (1949) used artificial acetate silk.

German Pat. No. 1,209,072 uses square-section threads of PVC (polyvinylchloride).

In contrast to the aforesaid prior art attempts to achieve a filament that permits the passage of ultraviolet rays, applicant uses an entirely different material, namely, nylon-6. Nylon-6, as well as various other known nylon type polyamides have been heretofore treated to avoid the harmful effects of light and heat as in the discoloration of the filaments, yarns or fabrics made therefrom, and to improve physical properties by providing non-circular cross-sections, for example. This is specifically exemplified in the following prior art U.S. Pat. Nos.:

Kimura et al. — 3,729,449

This patent relates to novel polyamide fibers or filaments which are circular or noncircular in cross section such as Y-shaped, T-shaped or H-shaped, obtained when spun through like shaped orifices. The patent mentions the inclusion of second components described merely as modifiers, stabilizers, coloring agents, pigments and other polymers. Antioxidants and conventional ultraviolet-ray absorbers are also mentioned. During polymerization there is added a mixture of copper acetate and potassium iodide to affect color tone and intrinsic viscosity. This patent does employ nylon-6, but not alone but rather in the preparation of a composite filament in combination with certain homopolymers of terephthalamides.

Anton — 3,377,314

This patent, like the Kimura et al. patent, includes a mixture of copper acetate and potassium iodide in the polymerization preparation of polyamide filaments which may be of lobed or odd cross section. The resulting yarn is resistant to loss of strength when exposed to ultraviolet light. Known delusterants such as titanium dioxide, barium sulfate and aluminum trioxide may be added.

Opfell — 3,558,420

This patent relates to the production of hollow filaments of synthetic polymers including polyamides and employing individual orifices of various cross sectional shape. The filaments may have additive ingredients including delusterants such as titanium dioxide, calcium acetate and other opaque compounds, and a variety of heat and light stabilizers.

Stamatoff — 2,630,421

This patent relates to the stabilization of polyamides and particularly against discoloration due to prolonged exposure to heat and light. Along with a benzimidazole stabilizer plus phosphorous compound used in the polyamide formation there may be included in combination therewith alkali metal halides as potassium and sodium bromides. The stabilizer composition suppresses color formation and embrittlement.

Stamatoff — 2,705,227

Like the earlier Stamatoff patent, this patent relates to the stabilization of polyamides, but with a combination of a copper compound and an inorganic halide such as sodium or potassium bromide, but preferably also in combination with a phosphorous. This stabilizing mixture is added during the condensation reaction with a polyamide salt to provide "fairly good color stability," column 6, lines 80–82.

Strachan — 3,156,607

This patent discloses lobed filaments of polyamides containing titanium dioxide as a delusterant, to avoid the formation of picks and snags.

Ellingsen — 3,109,768

This patent discloses filaments of synthetic polymers, including polyamides, having a pentagonal cross-sectional configuration for the purpose of reflecting a substantial part of incident light. Titanium dioxide may be added to reduce sheen.

SUMMARY OF THE INVENTION

The method of the present invention includes the steps of treating the nylon-6 polyamide in an aqueous bath containing about 0.5% of either potassium or sodium bromides, prior to spinning.

The spinning operation is carried out in an apparatus with intensive mixing capability as, for example an extruding machine of at least 20–24 D with a uniform and long dosage range as one-third of the length of the screw, thus being adapted to low viscosity of the material to be spun.

The spun material being at a temperature of about 200° C (melt spun) is immediately cooled by either passage through a water bath or cooled air. Alternatively, the filament may be quenched or cooled by passage over cooling cylinders. This cooling is accomplished quickly to room temperature and not exceeding 30°–40° C.

The cooling step is necessary to avoid the formation of spherulites. The latter appear whenever the filament reaches or exceeds to Brill point thereof. Spherulites are an obstacle to the possible passage by ultraviolet rays.

The Brill point is defined as the temperature above which the molecular mobility is large enough for the spherulites to be able to grow.

The metal spun filament is then subjected to an additional step of stretching or drawing by a conventional manner. This step provides necessary filament strength whenever such is deemed appropriate.

It is conventional to color polyamide filaments as when spinning into yarn or thereafter making fabrics therefrom. Nylon or polyamide dyes or pigments are well known and are discussed, for example, in "Encyclopedia of Chemistry," Clark-Hawley, 2nd and 3rd Editions, as well as in dye texts. Specifically, copper phthalocyanine is a recognized high temperature stable pigment and is suitable for admixture with polyamides for coloring purposes when desired. Further, it is preferred to use coloring agents which do not prevent the passage of light rays. Such agents or dyes are commercially available by the I.C.I. Company under the names "Methyl Violet 10 BNS," "Methyl Lake Violet 2B200" and "Waxoline Violet 2BNS" and appear perfectly pervious to ultraviolet rays, even in the dark shades. The Colour Index describes dyes of same family as follows:

Methyl Violet 10 BN — I.C.I., Generic name C.I. Basic Violet 3, No. 42555;

Methyl Lake Violet 2B — C.I. Basic Violet 1, No. 42535; and

Waxoline Violet 2BN — C.I. Solvent Violet 8, No. 42535.1

Coloring is, of course, an optional step.

It is next necessary to treat the filament with a solvent to avoid light refraction. Delustering of textile filaments is not in itself new. This is apparent from a review of the prior art cited above. In the main, titanium oxide is the preferred delusterant. Such a delusterant agent is dispersed in the polymer mass and causes the absorption of the ultraviolet rays. This result is in direct opposition to that necessary to permit the passage of ultraviolet rays in accord with the requirement of the present invention. According to another known method, the filament is covered with an oily film. Such a procedure is likewise not advantageous because the film is neither stable nor durable, and does not resist recurrent washings. Moreover, this oily film opposes the passage of ultraviolet rays, as is well known.

Delusterants such as titanium dioxide refract light and cause diffusion of light rays. Such agents must be excluded in the preparation of applicant's filaments. The solvent of the present invention is one which dissolves superficially the filament surface, which surface may be described as the shiny skin of the filament. Formic acid and copper lactate were found to meet the aforesaid polyamide surface solvent requirement. Copper lactate is used in the form of a saturate aqueous solution, and at a temperature of about 55° C. The filament is drawn through a bath of the solvent, whether formic acid or copper lactate, at the above temperature, and for a time sufficient to accomplish the desired removal of the shiny skin of the polyamide. Neither of these solvents causes refraction or diffusion of the light rays in fabric.

Following the aforesaid solvent treatment, the filament is again cooled, as after the bromide treatment, and for the purpose above described.

A further feature of the applicant's invention is the preference of ovalization of the filament to prevent diffusion and absorption of light rays through the yarn or fabric made therefrom. It has been found that there results a remarkable improvement in the perviousness due to a most favorable refraction of ultraviolet rays than is the case when the filament has a rectangular or square cross-section, as has been employed in the past.

Noncircular cross-section filaments are not new, as seen in the above described Kimura et al patent, for example. Such cross-sectional filaments are obtained by using noncircular orifices having the desired shaped orifices. In the case of applicant's invention, the polyamide mass is extruded through an oval-shaped orifice. Alternatively, the filament may be rolled to obtain an oval cross-section.

EXAMPLE I

A mass of nylon-6 polyamide, as in powder form, is treated in a bath of 0.5% aqueous solution of potassium bromide and then spun by extrusion with intensive mixing in an extruding machine, as above described in detail. The orifice of the extruder is oval-shaped to obtain the desired ovalization of the filament. The extruded filament being at a temperature of about 200° C is immediately cooled to room temperature but not exceeding 30°–40° C. This cooling is effected by water or cooled air, or by passing the filament over cooling cylinders. The thus-cooled filament is then treated with a saturated aqueous solution of copper lactate at a temperature of about 55° C to an extent sufficient to dissolve the superficial shiny surface of the filament. Thereafter, the thus treated filament is again cooled in the manner above described. The resulting filament enjoys good resistance to weathering and to heat, while permitting the major part of the light permeability thereof as manifest in yarn and fabric made therefrom.

EXAMPLE II

The same as Example I excepting that sodium bromide is used in place of potassium bromide to permit the passage of ultraviolet light through the filament.

EXAMPLE III

The same as Example I but using formic acid in place of copper lactate to dissolve the superficial surface of the filament.

EXAMPLE IV

The same as Example II but using formic acid in place of copper lactate to dissolve the superficial surface of the filament.

The aforesaid method of the invention is descriptive of various operations that are absolute requirements for the development of a filament with good textile properties, thus fulfilling the desired object of the invention. It is thus important that possible additions and mechanical treatments considered be compatible.

Accordingly, it is to be understood that the aforesaid representative examples may be varied within the scope of the entire specification disclosure as may be practiced by one skilled in the art, to achieve the same results. Thus, many changes may be brought therein without departing from the scope of the invention as defined by the following claims.

I claim:

1. A method of manufacturing a synthetic filament from nylon-6 to permit yarn or fabric made therefrom to be highly pervious to ultraviolet rays consisting essentially of treating nylon-6 in powder form in an aqueous solution containing about 0.5% of an alkali-metal salt selected from the group consisting of potassium bromide and sodium bromide melt-spinning the so-treated nylon-6 by extrusion with intimate mixing through an oval-shaped orifice to form an oval-shaped extruded spun filament having a temperature of about 200° C, immediately cooling the spun filament to the Brill point thereof in order to avoid the formation of spherulites which are an obstacle to the passage of ultraviolet rays, dissolving the superficial shiny surface of the cooled filament by drawing said filament through a bath of saturated aqueous solution of copper lactate or formic acid, at a temperature of about 55° C, again cooling to the Brill point, thus providing an oval-shaped nylon-6 filament that is pervious to ultraviolet rays.

2. A method in accordance with claim 1 wherein the melt spun filament is subjected to an additonal step of stretching or drawing to provide necessary filament strength.

3. A method in accordance with claim 1 wherein the melt spun filament is cooled to room temperature immediately after extrusion and also after dissolution of the superficial shiny surface of the filament.

4. A method in accordance with claim 1 wherein the bromide is sodium bromide.

5. A method in accordance with claim 1 wherein the bromide is potassium bromide.

6. A method in accordance with claim 1 wherein the solvent is copper lactate.

7. A method in accordance with claim 1 wherein the solvent is formic acid.

8. A nylon-6 filament made in accordance with the method of claim 1.

* * * * *